United States Patent [19]

Palmaer

[11] 4,155,493

[45] May 22, 1979

[54] CLOTHES-HANGER

[76] Inventor: Tore G. Palmaer, Kvainliden, S-330 30, Gnosjö, Sweden

[21] Appl. No.: 895,361

[22] Filed: Apr. 11, 1978

[30] Foreign Application Priority Data

Apr. 14, 1977 [SE] Sweden ..... 7704283

[51] Int. Cl.[2] ..... A47J 51/098

[52] U.S. Cl. ..... 223/85; 223/88; 224/45 P

[58] Field of Search ..... 223/85, 87, 88, 92; 16/110 R, 124; 224/45 P, 45 T; 206/289; 248/339, 340; 24/232 G, 233, 234

[56] References Cited

U.S. PATENT DOCUMENTS

| | | | |
|---|---|---|---|
| 459,431 | 9/1891 | Ziegler | 24/232 G |
| 747,745 | 12/1903 | Meilicke | 24/234 X |
| 2,500,729 | 3/1950 | Winnemore | 223/85 |
| 2,671,938 | 3/1954 | Roberts | 223/85 X |
| 2,876,938 | 3/1959 | Margolin | 223/85 |
| 3,136,019 | 6/1964 | Wolf | 223/88 X |
| 3,348,745 | 10/1967 | Basile et al. | 223/88 |
| 3,459,348 | 5/1969 | Masson | 223/87 |

FOREIGN PATENT DOCUMENTS

| | | | |
|---|---|---|---|
| 956173 | 4/1964 | United Kingdom | 24/232 G |

*Primary Examiner*—George H. Krizmanich

[57] ABSTRACT

A clothes-hanger is disclosed having a fixed hook member which pivotably supports a second hook member. The second hook member can pivot to a position in which it locks the hanger on a rail, but can be released by operating handle portions provided on the hook members.

6 Claims, 2 Drawing Figures

CLOTHES-HANGER

BACKGROUND TO THE INVENTION

Figure 1:
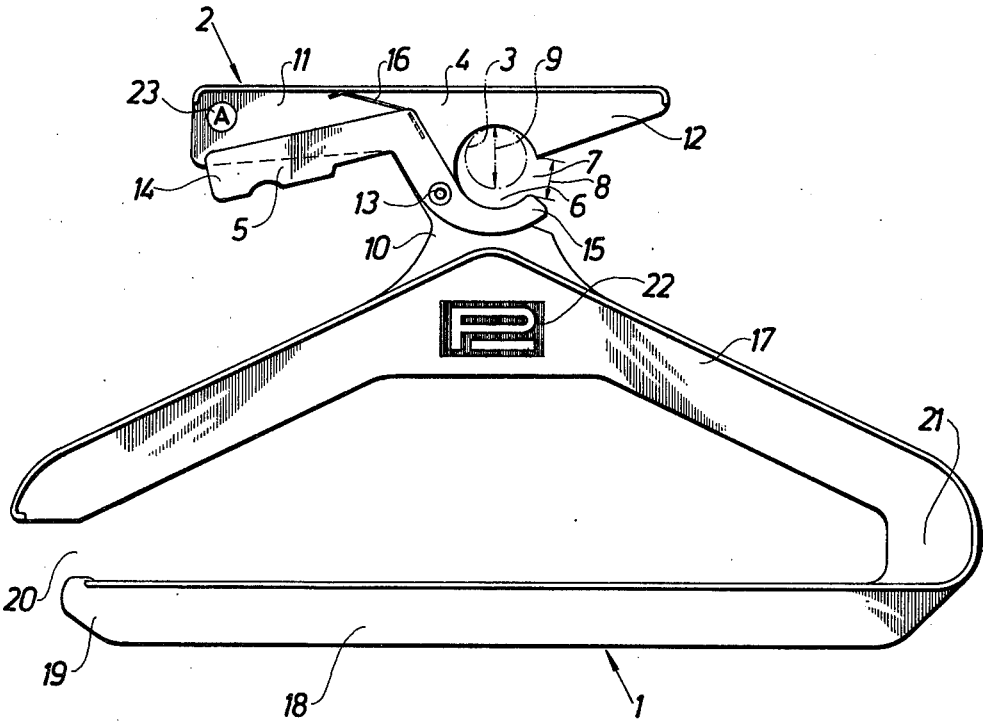

The present invention relates to a clothes-hanger and more particularly to a clothes-hanger provided with a hook for suspending the hanger on a clothes rail or the like. The hook comprises a member secured to the body of the hanger having a recess to receive the clothes rail and an opening leading to the recess so that the said member can be readily passed over a rail, the rail being received in the recess.

In conventional clothes-hangers a hook is provided which consists of an ordinary single hook screwed into the body of the hanger, if the hanger is made of wood, or attached to the body in some other convenient way, or made integrally with the hanger if the hanger is formed of wire or is integrally moulded from a plastics material. Such clothes-hangers may be utilised with clothes rails of many different shapes, but one disadvantage experienced with such hangers is that when a plurality of garments mounted on individual hangers are packed closely on a rail it is easy, when removing or hanging up another garment, accidentally to release an adjacent hanger from the rail so that it falls to the ground. Of course, this is a great inconvenience not only in the home, but also in cloakrooms and cupboards, and in premises which are open to the public such as restaurants, waiting rooms, offices, and the like. However, the disadvantage is especially inconvenient in shops where clothing is sold, particularly if the clothing if of a kind which is easily spoiled by being dropped on the floor, for example, clothing that is light in colour so that it becomes visibly dirty when the clothing is dropped on the floor.

This particular problem experienced with conventional clothes-hangers, namely the problem that the clothes-hangers are easily accidentally dislodged from the clothes rail so that they fall onto the floor, has been known for a long time and various proposals have been made which seek to solve this problem. Almost without exception these proposals involve the use of a especially designed clothes rail, the hook or hanging means provided on the clothes-hanger being specifically designed to cooperate with the special clothes rail. One example of a prior proposed clothes hanger of this type is a hanger in which the conventional hook is replaced by a hanging element comprising a shaft projecting vertically upwardly from the body of the hanger and terminating in a head. The clothes rail is in the form of a tube, and the lower side of the tube is provided with a plurality of longitudinally extending slots, each dimensioned to accommodate one of the shafts. A number of notches are provided which are connected to the slots, the notches being dimensioned so that the head on a shaft can be inserted into the tube through one of the notches, the head then engaging the sides of the slot so that the shaft is supported by the inside of the tube, the body of the hanger thus being suspended below the clothes rail. In commercially available embodiments of this proposal a hanger can only be removed from the clothes rail when its head is immediately opposite a notch and in order to remove a particular hanger from the clothes rail it may be necessary to push one or more other hangers past the notch, and thus one or more of the hangers may catch in the notch.

A hook arrangement which cannot be unintentionally dislodged from an ordinary rail has been proposed previously in connection with a hanger for suspending boots. This prior proposed hook arrangement comprises a hook member defining an eye, and a tongue which extends upwardly from the end of the eye adjacent the body of the boot hanger and which terminates a predetermined distance from the free end of the member forming the eye of the hook. This predetermined distance is less than the diameter of the clothes rail on which the hook is to be mounted, and the tongue is rigid in the plane of the eye, but is flexible in a direction perpendicular to this plane. The tongue thus prevents the hook from being unintentionally dislodged from the rail. The hanger is removed or hung up by withdrawing or inserting the hook member over the rail at an angle to the vertical plane so that the tongue can be pressed out of the way. It has been found that this particular design is suitable for use with hangers that are intended to support boots, since these hangers are not normally removed from the clothes rail once they have been hung up. This is because a conventional hanger for boots is provided with a clamp, which may resemble a large clothes-peg, which grips the upper edges of the legs of the boots to be supported. It has been found that this particular hook design is not, however, suitable for use with clothes-hangers, since the hanger must be inclined for removal and hanging up.

OBJECTS OF THE INVENTION

The primary object of the present invention is to provide a clothes hanger which, when suspended on a clothes rail, cannot be unintentionally dislodged therefrom, but which, in spite of this, is easy to hang or remove from the rail.

It is another object of the invention to provide a clothes hanger which can be readily manufactured.

SUMMARY OF THE INVENTION

According to this invention there is provided a clothes-hanger comprising a hanger body, a hook for suspending the hanger on a clothes rail, said hook comprising a first member secured to the body of the hanger, said first hook member defining a recess to receive a clothes rail and an opening leading to the recess so that the first hook member can be passed over a rail, the rail being received in the recess, a second hook member, the second hook member being rearwardly mounted in relation to the first hook member, and together with the first hook member forming a locking mechanism which, when the hanger is suspended on a rail, limits the width of the said opening leading to the recess, thus locking the hanger on the rail and preventing unintentional dislodgement of the hanger from the rail, and which in an open position permits the hanger readily to be removed from or hung up on a rail without inclining the hanger.

Preferably the second hook member is pivotable in a vertical plane in relation to the stationary first hook member when the hanger is mounted on a rail and conveniently the pivot axis for the pivoting movement of the second hook member is located so that the force of gravity acting on the second hook member at least contributes to the locking action of the said locking mechanism.

Preferably the movable second hook member is spring loaded in such a way that in the absence of any external influence the locking mechanism will assume a closed locking position.

sections 11 and 14 the free end of the trouser bar thus being on the same side of a notional vertical line through the recess 6 for the clothes rail as the handle sections 11 and 14. The free end 19 is separated from the upper portion 17 of the hanger by a space 20 through which the trousers can easily be passed when hanging the trousers on the bar 18, or when removing the trousers from the bar 18. The opposite end of the bar 18 is connected to the upper portion 17 of the hanger by a reinforced section 21.

The handle sections 11 and 14 are designed to compensate the difference in weight caused by the guide member 12, the reinforced section 21 and the opening 20 so that the hanger hangs vertically in relation to the horizontal plane when suspended from the clothes rail 3.

The surface 22 of the body 1 below the shaft 10 provides the space which can carry a logo, a trademark, the name of the company or the like, this surface being at the same time designed to provide reinforcement of the central part of the body 1. The side of the first handle section 11 provides a space to enable a marking 23 to be provided, this marking indicating, for instance, the style or size or price of a garment supported on the rail.

Figure 2:
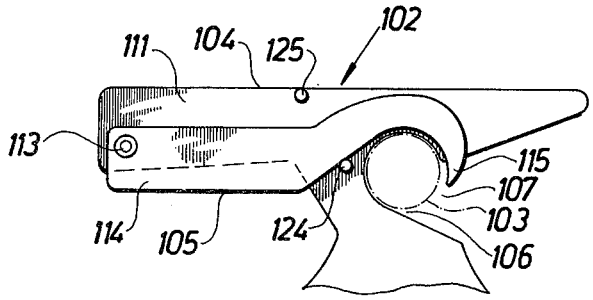

Referring now to FIG. 2 of the accompanying drawings which illustrates a second embodiment of the invention it will be appreciated that in this embodiment a stationary hook member 104 is provided constituting part of the hook device 102, the stationary hook 104 being substantially the same as the hook member 4 of the embodiment illustrated in FIG. 1. A peg or pivot support 113 is provided at the free end of the first handle section 111, and two stops 124 and 125 are provided which protrude from the plane of the hook member 114 to limit the pivotal movement of the second hook member 105 about the peg 113. The second hook member 105 comprises a second handle section 114 and a hook part 115, but the hook part 115 is located above the recess 106 and protrudes from above into the opening 107 limiting its width so that the clothes rail 103 is locked into the recess 106. In this embodiment of the invention the movable hook member 105 is pivotably journalled at one end so that the closing action caused by the force of gravity is extremely pronounced. In this embodiment, therefore, it is generally not necessary to provide any auxiliary spring means. It is to be appreciated that in all other respects the embodiment illustrated in FIG. 2 is similar to that described above and illustrated in FIG. 1.

It is to be appreciated that the clothes hanger in accordance with the present invention may be suitable for a valet stand. The horizontal upper side of the stationary hook member may in this case be utilized for supporting ties or socks.

It is to be appreciated that the invention is not limited to the preferred embodiments described above that may be varied within the scope and spirit of the following claims.

I claim:

1. A clothes-hanger comprising a hanger body, a hook for suspending the hanger body on a clothes rail, said hook comprising a stationary first hook member secured to the body of the hanger, said first hook member defining a recess to receive a clothes rail, an opening leading to the recess so that the first hook member can be passed over the rail and a first handle section, a second hook member pivotable in a vertical plane in relation to the stationary first hook member when the hanger hangs vertically on a rail, said second hook member having a locking portion cooperating with the stationary first hook member in one position to limit the width of the said opening leading to the recess, to permit the hanger to be locked on a rail and thus preventing unintentional dislodgement of the hanger from the rail, and in a second position to permit the hanger to be removed from or hung upon a rail without inclining the hanger, said movable second hook member having a second handle section which is arranged substantially side by side with the first handle section, the second handle section being movable in the vertical plane between a position in which the second handle section is substantially superimposed with the first handle section and a position in which said second handle section extends away from the first handle section, the locking position being in its first locking position when the second handle section extends away from said first handle section, and the locking portion being in its second opened position when the second handle section is substantially superimposed on the first handle section.

2. A clothes hanger according to claim 1 wherein the pivot axis for the pivoting movement of the second hook member is located so that the force of gravity acting on the second hook member at least contributes to the locking portion assuming a closed locking position.

3. A clothes-hanger according to claim 1 wherein the movable second hook member is spring biassed towards the closed locking position.

4. A clothes hanger according to claim 1 wherein the stationary first hook member is provided with guide means to guide the hanger when it is being hung on the rail, the guide means extending obliquely above the recess and being located on the opposite side of the recess to the first handle section.

5. A clothes-hanger according to claim 1 wherein the sections of the hanger balance one another so that when the hanger is suspended the hanger hangs vertically in relation to the horizontal plane.

6. A clothes-hanger according to claim 5 wherein the hanger comprises a trouser bar having a free end located below said handle sections.

* * * * *